US007850416B2

(12) United States Patent
Haug et al.

(10) Patent No.: US 7,850,416 B2
(45) Date of Patent: Dec. 14, 2010

(54) TURBOENGINE AND METHOD FOR ADJUSTING THE STATOR AND ROTOR OF A TURBOENGINE

(75) Inventors: Tilmann Haug, Weissenhorn (DE); Hans-Georg Lehmann, Esslingen (DE); Ansgar Zoller, Neu-Ulm (DE)

(73) Assignee: Daimler AG, Stuttgart (DE)

( * ) Notice: Subject to any disclaimer, the term of this patent is extended or adjusted under 35 U.S.C. 154(b) by 980 days.

(21) Appl. No.: 10/575,750

(22) PCT Filed: Sep. 15, 2004

(86) PCT No.: PCT/EP2004/010282

§ 371 (c)(1),
(2), (4) Date: Jan. 8, 2007

(87) PCT Pub. No.: WO2005/038199

PCT Pub. Date: Apr. 28, 2005

(65) Prior Publication Data

US 2007/0212216 A1 Sep. 13, 2007

(30) Foreign Application Priority Data

Oct. 13, 2003 (DE) ..... 103 47 524

(51) Int. Cl.
*F04D 29/08* (2006.01)

(52) U.S. Cl. ..... 415/1; 415/9; 415/173.4

(58) Field of Classification Search ..... 415/104, 415/107, 131, 132, 196, 173.1, 173.4, 174.4, 415/9; 384/100–120
See application file for complete search history.

(56) References Cited

U.S. PATENT DOCUMENTS

| | | | | | |
|---|---|---|---|---|---|
| 2,939,626 | A | | 6/1960 | Birmann | |
| 3,771,927 | A | * | 11/1973 | Schiller | 415/131 |
| 4,291,089 | A | * | 9/1981 | Adamovic | 428/325 |
| 4,374,173 | A | * | 2/1983 | Adamovic | 428/325 |
| 4,867,639 | A | * | 9/1989 | Strangman | 415/173.4 |
| 5,185,217 | A | * | 2/1993 | Miyamoto et al. | 428/627 |
| 5,196,471 | A | * | 3/1993 | Rangaswamy et al. | 524/406 |
| 5,434,210 | A | * | 7/1995 | Rangaswamy et al. | 524/406 |

(Continued)

FOREIGN PATENT DOCUMENTS

DE 196 53 217 A1 6/1996

(Continued)

OTHER PUBLICATIONS

Kawecki: "Thermal response turbine shroud study," Technical Report AFAPL-TR-79-2087, 1999, pp. 8-12, Pratt & Whitney Aircraft Group, Florida.

*Primary Examiner*—Edward Look
*Assistant Examiner*—Aaron R Eastman
(74) *Attorney, Agent, or Firm*—Patent Central LLC; Stephan A. Pendorf

(57) ABSTRACT

A turbo-machine (1), including a stator (2), internally coated with a running-in layer (6), a rotor (4) within the stator (2), wherein the turbo-machine (1) supplementally includes a device for parallel displacement and rotation of the rotation axis of the rotor (10) about the axis of symmetry of the stator (2). By means of this device the gap width between stator (2) and rotor (4) is minimized and therewith the economy of the turbo-machine (1) is increased.

15 Claims, 1 Drawing Sheet

U.S. PATENT DOCUMENTS 5,530,050 A * 6/1996 Rangaswamy ..... 524/430
5,658,125 A 8/1997 Burns et al.
5,785,493 A 7/1998 Ojima et al.
6,203,021 B1 * 3/2001 Wolfla et al. ..... 277/415
6,234,749 B1 * 5/2001 Hasegawa et al. ..... 415/173.4
6,290,455 B1 * 9/2001 Hemmelgarn et al. ..... 415/9
6,382,905 B1 * 5/2002 Czachor et al. ..... 415/9
6,547,522 B2 * 4/2003 Turnquist et al. ..... 415/173.3
6,619,913 B2 * 9/2003 Czachor et al. ..... 415/119

FOREIGN PATENT DOCUMENTS

EP 0 416 954 A1 3/1991
WO WO 99/28598 A1 6/1999

* cited by examiner

TURBOENGINE AND METHOD FOR ADJUSTING THE STATOR AND ROTOR OF A TURBOENGINE

CROSS REFERENCE TO RELATED APPLICATION

This application is a national stage of PCT/EP2004/010282 filed Sep. 15, 2004 and based upon DE 103 47 524.9 filed Oct. 13, 2003 under the International Convention.

BACKGROUND OF THE INVENTION

1. Field of the Invention

The invention concerns a turbo-machine as well as a process for conforming the stator and rotor of a turbo-machine.

It is known to apply coatings to the blades of a rotor as well as to the walls of a stator of turbo-machines, which coatings are capable of being abraded off, and which are relatively complex in their construction. These coatings are applied for adapting rotor and stator and for reduction of the gap width between the rotor blades of the rotor and the wall of the stator.

2. Description of Related Art

From document EP1312760A2 a turbo-machine is known, and more particularly a gas turbine with a rotor and a stator. The wall of the stator is coated with a running-in layer. In addition, the blades of the rotor are provided with an abrasive layer, in which arbitrarily abrasive $Al_2O_3$— or SiC-particles are embedded in such a manner that during the rotation of the rotor blade tips these unevenly abrasively wear away the running-in layer. By the abrasive wearing away of the running-in layer the $Al_2O_3$— or SiC-particles arbitrarily embedded in the abrasive layer break off. This leads to an increase of the gap width between stator and rotor blade tips, so that the degree of effectiveness of the turbo-machine, which depends in large part upon this gap width, is reduced with increasing running time and thus requires the frequent reapplication of the abrasive layer. For renewing the abrasive layer the rotor must be removed from the stator and disassembled in a labor intensive manner.

Similar designs are disclosed in the documents DE 19653217 A1 and U.S. Pat. No. 5,185,217.

SUMMARY OF THE INVENTION

The present invention begins with this state of the art and is concerned with a task of providing a turbo-machine as well as a process for adapting stator and rotor in a turbo-machine, in which the gap width between stator and rotor is minimized.

The inventive solution is provided by a turbo-machine including:

- a stator, internally coated with a running-in coating,
- a rotor within the stator, wherein the turbo-machine supplementally includes:
- a device for parallel displacement and rotation of the rotation axis of the rotor about the axis of symmetry of the stator.

This design has the advantage, that the degree of effectiveness of the turbo-machine is increased by reducing the gap width between the stator and rotor.

Further, the inventive turbo-machine ensures an almost even wearing away of the running-in layer by the blades of the rotor. This has the advantage, that the blades of the rotor transmit small moments upon the stator. A reduced bending and compression of the rotor is the consequence. Overall, the dynamic deformations which occur—which have an effect on the blades of the rotor—are noticeably reduced.

The device for parallel displacement and rotation of the rotation axis of the rotor can be realized using a modified conventional slide bearing (sliding contact bearing). This type of slide bearing includes a shaft, which rotates within a housing internally coated with a bearing layer. Between bearing layer and shaft there is a gap, the so-called bearing play, which is commonly filled with a liquid, usually oil. The gap width varies between 50 and 500 μm, usually between 100 and 300 μm, depending upon intended use of the slide bearing. If the liquid is partially or completely removed, then the shaft, and along with it its rotation axis, is displaced, due to centrifugal forces, parallel to the axis of symmetry of the housing. As more liquid is removed, so also degree of displacement is correspondingly increased.

For the inventive turbo machine, essentially a rotor is placed axially symmetrically on the shaft, and the modified slide bearing is positioned axially symmetrically relative to the stator. Thereafter, the shaft, with rotor, is caused to rotate and scrapes away a part of the running-in layer. Subsequently, the rotor can be centered again by re-filling to remove the bearing play.

A further advantage of the inventive turbo-machine as comprised therein, that in comparison to the conventional turbo-machines an abrasive coating on the blade tips of the rotor can be dispensed with. Therewith the application of the abrasive coating on the blade tips and a finished processing of this friction coating can be dispensed with, on the basis of the free rotation of the rotor in the stator with the wall of the stator coated over-dimensionally with running-in coating.

Besides the saving of work or process steps the inventive design of the turbo-machine possesses a more robust design with regard to the manufacturing tolerances, since a classification of components with regard to the orientation of fit is necessary only in a reduced degree. The parallel displacement of the rotation axis of the rotor to the axis of symmetry of the stator leads thereto, that a possible occurrence of finishing tolerances, in particular the inter diameter of the stator and/or the internal coating on the wall of the stator, can be compensated for.

Preferably the device displaces the rotation axis of the rotor in such a manner, that the rotor is introduceable concentrically into the wall of the stator coated with running-in coating.

Therein for example the symmetry axis of the wall of the stator coated with running-in coating runs parallel offset to the axis of symmetry of the stator bore in the stator housing. Therewith there essentially occurs a wearing down of the construction space necessary for the free rotation of the rotor and the stator by the rotation of the guide blades of the rotor in such a manner that the thus formed gap-width between the rotor blade tips and the stator remain minimal. This makes possible an economic operation of the turbo-machine.

It is particularly advantageous herein, that by means of the inventive device for parallel displacement and rotation both turbo-machine components with large manufacturing tolerances as well as very precise finished components, in particular the bearing of the stator housing and the stator housing itself, can be paired with each other without the degree of effectiveness of the turbo-machine being significantly negatively influenced thereby.

Alternatively, the device for parallel displacement and rotation can displace the rotor within the over-dimensionally internally coated stator in such a manner that the rotation axis of the rotor is displaced parallel to the symmetry axis of the running-in coating coated wall of the stator, which runs parallel offset to the symmetry axis of the stator. This embodiment allows the circumferential abrading or wearing away of the space necessary for the free rotation of the rotor in the stator, whereby the displacement between the symmetry of axis of the stator and the axis of symmetry of the running-in coating coated wall of the stator can be equalized or compensated.

In an advantageous embodiment of the inventive turbo-machine the blades of the rotor contain an aluminum based alloy or iron alloy or cobalt based or nickel based alloy and the stator contain an aluminum based alloy or steel casting.

In turbo-machines, in particular in power plants and in compressors as well as in exhaust gas turbocharges the blades are subject to very high complex thermo-mechanical loads. Additionally, the high temperatures and aggressive environmental media requires oxidation and corrosion processing of the blades and the stator housing of the turbo-machine. Thus in this connection high temperature resistant and creep resistant iron based or cobalt based or nickel based alloys are preferably employed for the blades of a turbine wheel in the turbo-machine. On the basis of the low thermal mechanical loads the blades of the compressor can be comprised of aluminum based or iron based alloys. It is further conceivable that the turbine and/or compressor blades are formed of metal-based composite materials. For the stator housing, steel casting is preferably employed in the area of the turbine due to the high thermal loads. By the sucking in and compressing of the cold combustion air for the compressor housing, due to these thermal loads an aluminum based alloy may be employed.

In a further embodiment of the turbo-machine, the running-in coating on the wall of the stator contains AlSi12 or NiCrAl.

This running-in layer or coating has the advantage, that it exhibits a cross section or machined surface with substantially small grooves after the rotor blade rubbing or abrading process and exhibits a minimal gap width between the rotating rotor blade tips and the solid wall of the stator of the turbo-machine. The coating of the wall of the stator on the compressor side with the running-in layer of AlSi12 and a filler has the advantage, that the coating material exhibits a thermal coefficient of expansion adapted to the base material of the stator housing. The filler, which is contained in the AlSi12 layer, burns out at higher temperatures, whereby the porosity of the running-in layer is increased. Therein the running-in layer of AlSi12 is expansion tolerant and exhibits a good adhesion to the base material of the stator housing.

By the high temperature tolerance of the running-in layer of NiCrAl this can be employed both as coating material for components of the turbine which are subjected to high temperature load as well as in the thermally less stressed compressor side. The NiCrAl running-in layer contains a filler material similar to or corresponding to the running-in material of the compressor side. The running-in material on the compressor and on the turbine side make possible high degrees of effectiveness and reduced fuel consumption.

A further object of the present convention concerns a process for adapting stator and rotor of a turbo-machine, wherein a running-in layer is applied to the wall of the stator and this running-in layer is eroded or abraded at least partially by the rotor, wherein the rotor is rotated about a rotation axis, which is offset parallel to the axis of symmetry of the stator.

An advantage of the inventive process is comprised therein, that manufacturing tolerances such as, for example, the dimensions, the shape, and the position of the wall of the stator and/or the inter diameter of the wall of the stator coated with the running-in layer have a less critical influence on the gap size between the rotor blade tips and stator housing. This allows a simple adapting of stator and rotor of the turbo-machine independent of whether the axis of symmetry of the rotor corresponds with that of the stator or runs offset parallel thereto. Thereby the inventive process enables an optimal orientation of the rotating rotor to the running-in layer coated wall of the stator.

Beyond this, the process for conforming stator and rotor allows a minimization of the blade mass in that the abrasion layer on the blade tips is not necessary. A reduced mass of the blades reduces the inertia of the rotor, so that the dynamic response of the rotor in the case of variable load is improved and overall the dynamic mass forces, which act upon the blades during operation, are reduced.

In an advantageous embodiment of the inventive process the rotor is introduced into the stator while rotating.

This embodiment has the advantage, that now the rotor rotating about the rotation axis evenly abrades or removes the wall on the rotation-symmetric surface in such a manner, that only the necessary construction or installation space is cleared away by the rotating rotor and the tolerances within the turbo-machine are cleared. By the abrading or erosion of the running-in layer of the wall over its entire circumference a minimal gap-width is established between rotor blade tips and stator. Upon the conformance of stator and rotor the surface of the abrasive changed running-in coatings appears slightly ruffled, so that a profiling of the running-in surface can be achieved, without complex preparation and finished processing of the coating surface of the running-in layer after the coating process, without complex follow-up processing of the blade tips of the rotor, and without expensive pairing of the components of the turbo-machine running in each other. By the reduction of the vertical integration (in house manufacturing) the manufacture or as the case may be assembly of these turbo-machines is found to be very efficient and economical.

Further, the rotor can be introduced with reversing rotation into the stator. The term "reversing" herein means that a rotating rotor is first introduced into the stator a distance of 1 to 2 mm with removal of some of the material of the running-in layer, then with rotation is retracted approximately 1 to 2 mm, whereupon the material removed from the running-in layer and often at least partially clinging to the blade tips of the rotor can release itself. Thereupon the rotating rotor is introduced a distance of 1 to 2 mm into the stator beyond the previous 1 to 2 mm, and thereafter is again retracted. This alternating between advancing and retracting is repeated so long, until the rotor has removed the running-in layer to the desired thickness in the desired depth of the stator.

This embodiment has the advantage that on the one hand the blades experience a reduced load in the axial direction and on the other hand the gap width is minimized on the basis of the smaller rotor blade loads and the therewith reduce rotor blade deformations. Further, the formation of tread patterns on the running-in layer is reduced.

BRIEF DESCRIPTION OF THE DRAWINGS

In the following the inventive subject matter will be described in greater detail on the basis of illustrative embodiments and the figure. Further characteristics and advantages of the invention can be seen from the figure and the associated description. There is shown.

DETAILED DESCRIPTION OF THE INVENTION

Figure 1:
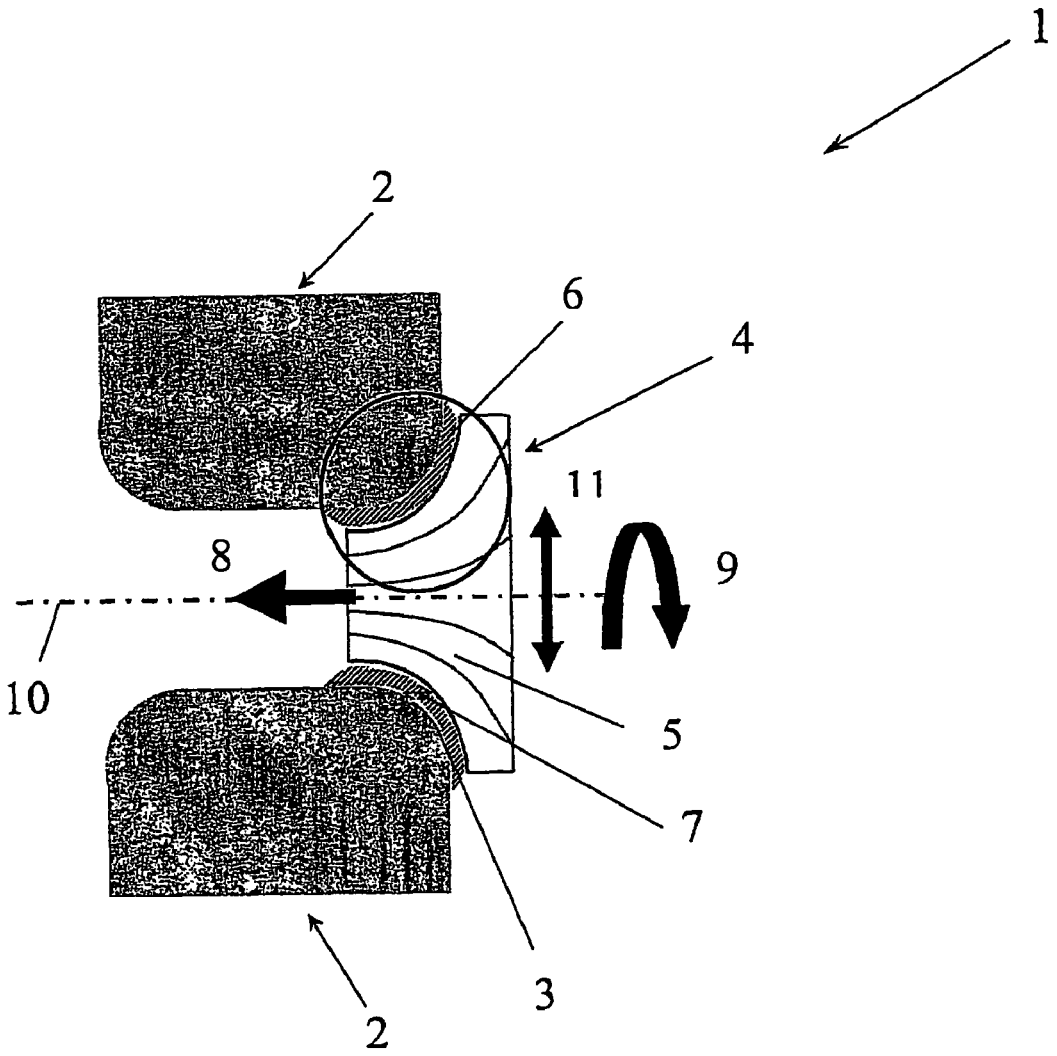
FIG. 1 the schematic side view of a turbo-machine, wherein the stator is internally coated with a running-in layer.

In FIG. 1 there is shown, not to scale, an example of an illustrative embodiment of the inventive turbo-machine 1, in particular a compressor side of a exhaust gas turbocharger with a stator 2 and a rotor 4. In this embodiment the stator 2 exhibits a wall 3, which is coated with a running-in layer 6. Within the stator 2 the rotor 4 is introduced as a compressor wheel with rotor blades 5. In order to produce a minimal gap width 7 between the stator 2, internally coated with the running-in layer 6, and the rotor blades 5 of the rotor 4, the rotor 4 is introduced in the direction of movement 8 into the stator 2 rotating in the rotational direction 9 about its rotation axis 10. The positioning of the rotor 4 and the stator 2 occurs by means of a here not in greater detail shown device for parallel displacement in the displacement direction 11 and rotation of the rotor 4 about the axis of symmetry of the stator 2.

The device for parallel displacement and rotation of the rotation axis of the rotor 4 is comprised of a modified conventional slide bearing. The slide bearing includes a shaft, which rotates within a housing internally coated with a bearing layer. Between bearing layer and shaft there is a 200 μm ring-like gap, the so-called bearing play, which is filled with oil. Oil is removed until a minimum amount remains adhered to the bearing layer, and as a result the shaft, and along with it its rotation axis, is displaced due to centrifugal forces parallel to the axis of symmetry of the housing. Therein the degree of displacement corresponds to the volume of removed oil.

According to this embodiment, the rotor 4 is placed axially symmetrically on the shaft and the modified slide bearing is positioned axially symmetrically relative to the stator 2. Thereafter the shaft, including rotor, is caused to rotate and removes a part of the running-in layer 6. Subsequently, the rotor 4 can be centered by re-filling the gap or bearing play.

This positioning of the rotor 4 in the stator 2 with the aid of the device, not shown in greater detail, is suited for selected material parings at the rotation symmetric surfaces. Therein the rotor blades 5 of the rotor 4 on the compressor side of the exhaust gas turbocharger as well as the stator 2 are comprised of an aluminum based alloy, wherein the wall 3 of the stator 2 is coated with a running-in layer 6 of AlSi12 and polyester as filler.

On the basis of the high temperatures of approximately 1050° C. on the hot turbine side of the exhaust turbocharger high temperature materials are employed. The turbine side guide blades of the rotor are produced of a Ni-based alloy and the stator of cast steal. The wall of the stator on the turbine side is coated with running-in layer of NiCrAl and polyester as filler.

As shown in FIG. 1, the rotor 4 is introduced rotatingly into the running-in coating 6 internally coated stator 2 of the compressor side of the exhaust gas turbocharger. Therein the running-in layer 6 of AlSi12 is abraded or removed during the positioning at least partially, so that the rotor 4 is rotated about its rotation axis, which is displaced parallel to the axis of the stator 2.

The invention is not limited to the above-described example of an exhaust gas turbocharger, but rather can be applied to stationary gas turbines and power plants. Further, there is the possibility that the running-in coating on the hot gas side can contain NiCrAlY with filler or, for example, ceramic or another high temperature resistant material.

REFERENCE NUMBER LIST

1. Turbo-Machine
2. Stator
3. Wall
4. Rotor
5. Rotor Blades of the Rotor
6. Running-in Layer
7. Gap Width
8. Direction of movement of the rotor
9. Direction of rotation of the rotor
10. Rotation Axis of the Rotor
11. Direction of displacement of the rotation axis of the rotor

The invention claimed is:

1. A turbo-machine (1), including:

a stator (2), internally coated with a running-in layer (6), the stator having a surface (3) dimensioned for close passage of a rotor, this surface (3) having an axis of symmetry and coated with said running-in layer, a rotor (4) configured for rotation within the stator (2), the rotor having an axis of rotation and having rotor blades (5) configured for close passage to said stator surface (3), and a device on which the rotor is mounted for radial displacement and rotation of the rotation axis of the rotor (10) about the axis of symmetry of the stator (2), resulting in the rotation axis of the rotor orbiting about the axis of symmetry of the stator (2) for at least partially wearing away or abrading said running-in layer.

2. The turbo-machine (1) according to claim 1, wherein the rotor blades (5) of the rotor (4) contain aluminum based alloys or iron based alloys or cobalt based alloys or nickel based alloys and the stator contains (2) aluminum based alloys or cast steel.

3. The turbo-machine (1) according to claim 1, wherein the running-in layer contains AlSi12 or NiCrAl.

4. The turbo-machine (1) according to claim 1, wherein the rotor is rotatingly supported in said device by a bearing with an oil-filled gap, and wherein said device further comprising means for adjusting the amount of oil in the gap.

5. The turbo-machine (1) according to claim 4, wherein said bearing is a floating bearing in which a gap of between 50 and 500 μm can be filled with oil, and wherein said radial displacement is caused by removing at least part of said oil from said gap.

6. The turbo-machine (1) according to claim 5, wherein said gap is between 100 and 300 μm.

7. The turbo-machine (1) according to claim 1, wherein the turbo-machine is a turbocharger comprising a compressor wheel in a compressor housing, a turbine wheel in a turbine housing, a shaft connecting said compressor wheel and turbine wheel, said shaft mounted for rotation in said bearing housing.

8. The turbo-machine (1) according to claim 7, wherein the stator is a turbine housing and the rotor is a turbine wheel.

9. The turbo-machine (1) according to claim 7, wherein the stator is a compressor housing and the rotor is a compressor wheel.

10. The turbo-machine (1) according to claim 7, wherein the compressor wheel and turbine wheel are placed axially symmetrically on the shaft, and the shaft bearing is positioned axially symmetrically relative to the stator, the shaft, with rotor, is caused to rotate with radial displacement and rotation of the rotation axis of the rotor (10) about the axis of symmetry of the stator (2), thereby scraping away a part of the running-in layer.

11. A process for adapting stator (2) and rotor (4) of a turbo-machine (1), the rotor having rotor blades (5) adapted for close passage to a stator, the stator having a surface (3) adapted for close passage of the rotor blades, the surface (3) having an axis of symmetry, said process comprising:

applying a running-in layer (6) upon the stator (2) at least in the area of the surface (3) adapted for close passage of the rotor blades, mounting the rotor to a device allowing radial displacement of the rotation axis of the rotor (10), joining the device, with rotor mounted thereto, to the stator, and at least partially wearing away or abrading this running-in layer (6) by the rotor (4), by rotating said rotor about the rotation axis of the rotor, while simultaneously rotating the rotation axis of the rotor (10), radially displaced from the axis of symmetry of the stator (2), to orbit about the the axis of symmetry of the stator (2).

12. The process according to claim 11, wherein the rotor (4) is introduced rotatingly into the stator (2).

13. The process according to claim 11, wherein the rotor is supported for rotation by a bearing with an oil-filled gap, and wherein said radial displacement is adjusted by adjusting the amount of oil in the gap.

14. The process according to claim 13, wherein said bearing is a floating bearing in which a gap of between 50 and 500 μm can be filled with oil, and wherein said radial displacement is caused by removing at least part of said oil from said gap.

15. The process according to claim 13, wherein said gap is between 100 and 300 μm.

* * * * *